US006561002B2

(12) United States Patent
Okada et al.

(10) Patent No.: US 6,561,002 B2
(45) Date of Patent: May 13, 2003

(54) INCREMENTAL FORMING METHOD AND APPARATUS FOR THE SAME

(75) Inventors: Norihisa Okada, Hikari (JP); Wataru Kawamura, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/832,007

(22) Filed: Apr. 11, 2001

(65) Prior Publication Data

US 2001/0029768 A1 Oct. 18, 2001

(51) Int. Cl.[7] ..... B21D 22/18
(52) U.S. Cl. ..... 72/115; 72/220; 72/379.2
(58) Field of Search ..... 72/74, 115, 117, 72/215, 220, 379.2

(56) References Cited

U.S. PATENT DOCUMENTS 1,011,000 A * 12/1911 Worth et al. ..... 72/115
2,624,303 A * 1/1953 Ghormley ..... 72/117
2,653,561 A * 9/1953 Stiefelmayer ..... 72/115
2,864,329 A * 12/1958 Woods et al. ..... 72/117
4,399,679 A * 8/1983 King ..... 72/117
5,228,190 A * 7/1993 Sawa ..... 72/220

* cited by examiner

*Primary Examiner*—Lowell A. Larson
(74) *Attorney, Agent, or Firm*—Antonelli, Terry, Stout & Kraus, LLP

(57) ABSTRACT

In a state in which a material (blank) cut in a predetermined shape is mounted on a die and the bottom of the material is supported by a seat, the material is pressed by a tool from above and the tool is moved along the die so that the material is incrementally formed. The bottom of the material is fixed, so that the material is not inclined and can be formed in a predetermined shape. A circular arc portion of a flange is processed in a state in which it is clamped by the female die and the tool, so that the circular arc portion of the flange is not spread outside and the perpendicularity between the flange of the circular arc portion and the bottom can be increased.

47 Claims, 12 Drawing Sheets

INCREMENTAL FORMING METHOD AND APPARATUS FOR THE SAME

BACKGROUND OF INVENTION

The present invention relates to an incremental forming method for gradually processing a plate; and, more particularly, the invention relates to an incremental forming method for producing a molded product having a flange in an end portion of a plate.

Conventionally, a molded product having a flange at an end portion of a plate is manufactured by inserting and pressing the plate between a female die and a male die. Since the female die and the male die are required, the price becomes high.

As a means for reducing the number of dies, an incremental forming method has proposed, as shown in FIGS. 18 to 20 in Japanese patent application laid-open publication Hei 11-310371. In this method, an outer periphery of a piece of material is fixed to a female die, the material is pressed with a rod-shaped tool, the rod-shaped tool is moved along an inner peripheral face of the female die, and a sponson processing is incrementally carried out on the plate. On the other hand, in Japanese patent application laid-open publication Hei 10-76321, a plate is subjected to a drawing processing.

The above-described incremental forming method uses only one die, so that it is inexpensive. However, in a manner shown in the above-stated Japanese patent application laid-open publication Hei 11-310371, when a flange is formed at an end portion of the plate, a portion of the plate is left at the outer periphery of the flange. When this plate portion is unnecessary, it is necessary to cut off and remove the outer peripheral portion of the flange. Further, when the flange is formed according to this processing procedure, the angle formed between the flange and the plate bottom is not formed as a rectangular angle. For example, when a cylinder is overlapped and joined to the flange, when the flange is not formed in a rectangular shape, it hard to carry out overlapping welding. Further, it is difficult to form a flange having a high height.

On the other hand, when the flange is formed according to the manner shown in Japanese patent application laid-open publication Hei 10-76321, a wrinkle occurs easily on a comer portion of the flange.

SUMMARY OF THE INVENTION

An object of the present invention is to provide an incremental forming method for easily forming a plate in a predetermined shape.

The above-stated object can be attained by an incremental forming method, wherein, under a condition where a piece of material is fixed to a seat arranged inside of a female die, with the piece of material arranged between the female die and a tool member and between the seat and the tool member, and under a condition where an outer end portion of the material is capable of movement in a drawing processing direction, the seat and the tool member are relatively moved in the female die in a drawing processing direction, and the tool member is relatively moved along an inner peripheral face of the female die.

DESCRIPTION OF THE INVENTION

Figure 1:
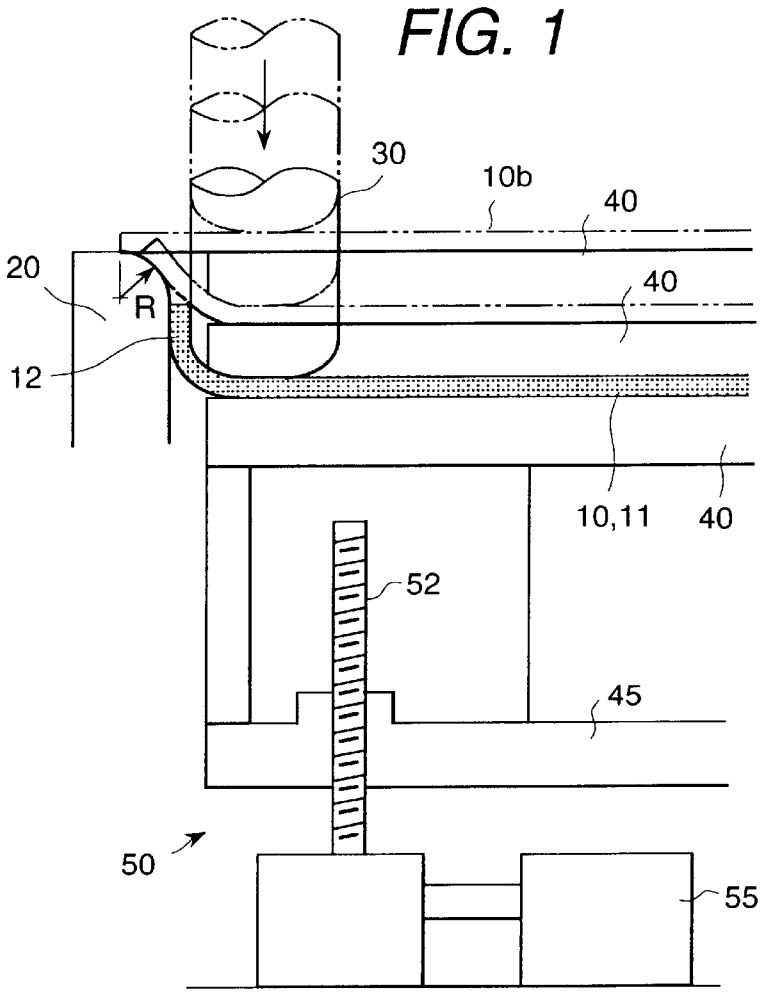
FIG. 1 is a longitudinal cross sectional view of the essential section of a forming apparatus representing one embodiment according to the present invention.
Figure 2:
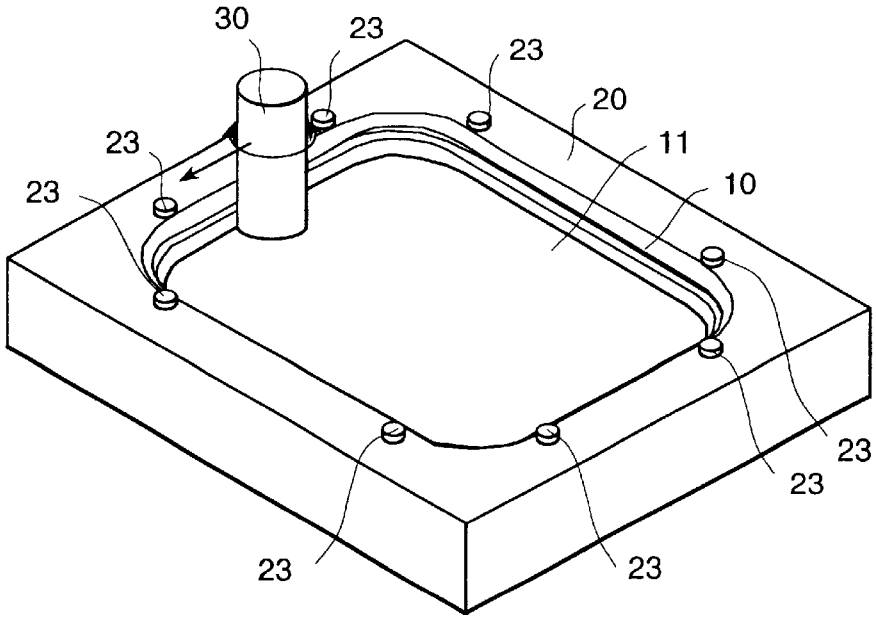
FIG. 2 is a perspective view showing the relationship between a die during forming, a female die, a rod-shaped tool, and an article to be processed.

A first embodiment of an incremental forming method and an apparatus for carrying out the method according to the present invention will be explained with reference to FIG. 1 to FIG. 5. FIG. 1 shows substantially only the left end portion of the apparatus, and it should be understood that this apparatus is symmetrical on right and left sides. FIG. 2 shows a condition during forming of a molded product.

Figure 4:
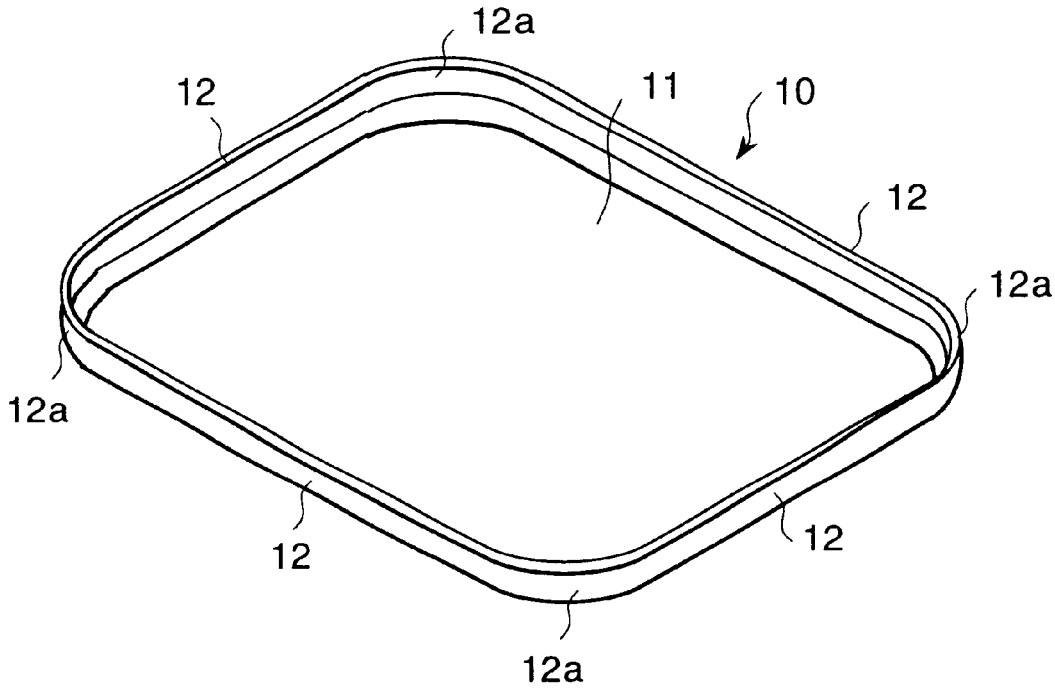
FIG. 4 is a perspective view showing a molded product.

As seen in FIG. 4, a molded product 10 has a bottom 11, and a flange 12 is provided on an outer peripheral portion thereof. The molded product 10 is composed of four sides, and each side is linear, while a corner portion 12*a* where two adjacent sides are joined has a circular arc shape. The face of the bottom 11 and the face of the flange 12 are almost perpendicular to each other. The molded product 10 can be used by itself, and, in addition to this, it can be used as a cover forming an end portion of a cylindrical member. When the flange 10 and the end portion of the cylindrical member are overlapped and fixed, it is desirable to form the flange 12 and the bottom 11 so that they are orthogonal to each other.

The die 20 shown in FIG. 2 is a female die (an outer die). The female die 20 is disposed horizontally in use. On an upper face of the female die 20, a plate 10*b* of the product material is mounted. During the forming operation, the rod-shaped tool 30 is inserted by a predetermined distance into an inner portion of the female die 20. The tool 30 moves down along a perpendicular face of the female die 20 and then moves along the length of the inner peripheral face of the female die 20. The shape of the inner peripheral face of the female die 20 is substantially the same as the shape of the outer face of the molded product 10. When the tool 30 makes one revolution around the female die 20, the tool 30 repeats the above-stated operation. By doing this, a flat plate 10*b* of the material is subjected to drawing processing. Moving the tool 30 down is referred to as moving it in the drawing processing direction. This is movement of the tool 30 in an axial direction, that is, in the direction of the depth of the molded product 10.

The tip end of the tool 30 is flat. A corner portion from the tip end toward a side face is circular arc shaped. The circular arc is formed by the bottom 11 of the molded product 10 and the flange 12. The tool 30 is suspended from an upper mobile body (not shown in the drawing) so as to freely rotate. The tool 30 moves along the inner peripheral face of the female die 20 (corresponded to a portion of the flange 12). The tool 30 moves in contact with the material 10*b*, so that the tool 30 rotates as it follows the flange surface (a periodic rotation). Because of this rotation, the tool 30 does not touch the material 10*b* at only one point, so that it can be prevented from seizing. Further, on the upper face of the material 10*b*, a lubrication oil is coated.

A plurality of pins (guides) 23 for positioning the material 10*b* are set on an upper face of the female die 20. When the flat plate of the material 10*b* is placed on the upper end of the female die 20, the pins 23 are in contact with the outer peripheral edge of the material 10*b*. The material is positioned by these pins. The upper end of the female die 20 on the inner peripheral side has a circular arc shape of radius R, as seen in FIG. 1. This circular arc shape is provided along the whole periphery of the female die 20. By means of this circular arc shaped surface, the outer peripheral portion of the material 10*b* is able to smoothly move down on the inner peripheral side of the female die 20 in response to the downward pressure of the tool 30.

The interior portion of the female die 20 has no bottom. Thus, a seat 40 is provided for mounting the material 10*b* inside the female die 20. The seat 40 is supported by a device 50 for controlling the height and position of the seat 40. The outer portion of the seat 40 is disposed opposite to the tip end (the lower end) of the tool 30. This outer portion of the seat 40 is installed in the portion of the female die 20 corresponding to the locus of movement of the tool 30 in the peripheral direction. Namely, the material 10*b* is clamped by the tip end of the tool 30 and the seat 40. Furthermore, there is an outer portion of the seat 40 at the center of the female die 20. Therefore, the center portion of the material 10*b* can be fixed.

The seat 40 mounts (loads) and fixes the material 10*b*. This fixing is realized by the magnetic force of an electromagnet installed in the seat 40. Or, a vacuum adsorption pad is installed on the top of the seat 40, and the fixing is realized by a vacuum adsorption. The fixing position is approximately at the center portion of the seat 40. The material 10*b* is an iron series, a stainless steel series, or an aluminum alloy series mounted.

The device 50 for moving the seat 40 up and down will be explained hereunder. The device 50 is composed of a plurality of screw mechanisms 51. An example of a screw mechanism is shown in FIG. 1. A seat 45 disposed beneath the seat 40 is supported by a screw bar 52 of the screw mechanism 51. The seat 45 carries a nut which can rotate freely. When a driving device 55 rotates, the screw bar 52 rotates and the seat 40 moves up or down. Between the seat 40 or the seat 45 and the base, a plurality of guides (not shown in the drawing) are provided to ensure that the seat 40 will move up and down vertically. The device 50 and the female die 20 are installed on the base (foundation).

Figure 5:
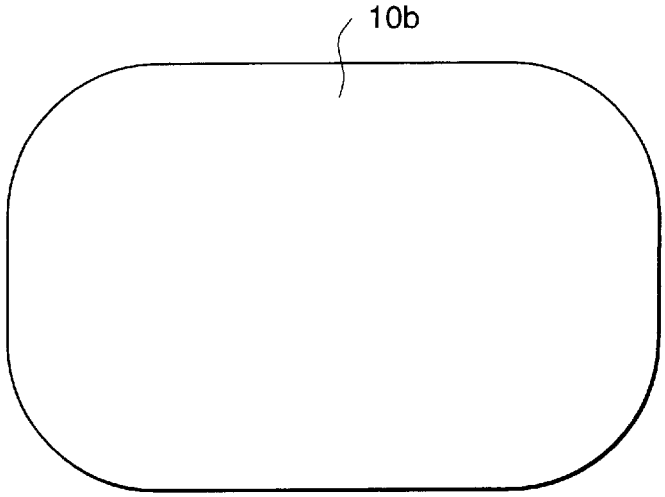
FIG. 5 is a plan view showing a piece of material.

The incremental forming method will be explained hereunder. Firstly, the flat-plate material (blank) 10*b*, developed on the basis of the shape to be obtained after the forming, is prepared. Since the molded product 10 in the illustrated example has a four-sided shape and a circular arc part at the comer portions, a plan view of the material 10*b* exhibits a substantially four-sided shape, with the comer portions thereof having a circular arc shape, as shown in FIG. 5. The size and the shape of the material 10*b* and the shape of the circular arc at the corner portion thereof are determined by taking into consideration the desired shape of the molded product 10. In the above-stated development, the development dimensions are calculated on the basis of the surface area and the volume of the molded product in the same way as with the square cylinder drawing processing. On the basis of these development dimensions, a plate is cut out by a turret punch press.

Next, the material 10*b* is put on the upper surface of the female die 20. At this time, the seat 40 is moved up into contact with the material 10*b*. The material 10*b* is positioned horizontally by the pins 23 and supported by the seat 40 at this point in the process.

Next, the material 10*b* is fixed to the seat 40. The fixing position and the means to secure the material 10*b* to the seat 40 are as specified previously.

Next, the seat 40 is moved down and the tool 30 is also moved down. The position to which the tool 30 is lowered at this time is a position where the material 10*b* is disposed between the side face of the tool 30 and the vertical face (the inner peripheral face, the linear portion) of the female die 20. Namely, the material 10*b* is clamped between the inner peripheral face of the female die 20 and the side face of the tool 30. Under this condition, the tool 30 is incrementally lowered, and as will be described later, the tool is moved in the peripheral direction along the inner peripheral face of the female die 20. The tool 30 is lowered to a position where the tip end of the tool 30 is in contact with the material 10*b*. For example, before the seat 40 has been lowered, when the upper face of the seat 40 is positioned in the same plane as the upper face (the position where the end portion of the material 10*b* is mounted) of the female die 20, and when the tip end of the tool 30 is in contact with the upper face of the material 10*b*, the amount by which the seat 40 is lowered and the amount by which the tool 30 is lowered are the same. The seat and the tool can be lowered at the same time.

When the bottom plate 11 is wide, and the plate is thin, and the center portion of the bottom plate 11 is fixed, as shown in this embodiment, there is no need to bend the outer peripheral portion using the female die 20 because only the bottom plate 11 bends. Therefore, there is the possibility that the material 10*b* may be inclined. As will be described later, when the tool 30 is moved in the peripheral direction, there is the possibility that the material 10*b* may rotate. Therefore, the material 10*b* is fixed to the seat 40.

The lower position of the tool 30 is the position where the flange 12 can be positioned between the side face of the tool 30 and the inner peripheral face of the female die 20. The perpendicularity (the angularity) of the flange 12 is taken into account. When perpendicularity of the flange 12 is taken into account, the tool 30 is positioned so as to clamp the material 10*b* between the side face of the tool 30 and the inner peripheral face of the female die 20.

Next, the tool 30 is moved along the inner peripheral face of the female die 20. The tool 30 rotates as it follows the inner periphery of the female die 20. The material 10*b* is incrementally formed by movement of the tool 30.

Next, whenever the tool 30 makes a round, as stated above, the seat 40 is moved down and the tool 30 is moved down. The incremental distances of movement of the two and the position of the tool 30 are as specified previously. Next, the tool 30 is moved once again in the peripheral direction along the inner peripheral face of the female die 20.

After that, the lowering of the seat 40 and the tool 30 and the movement of the tool 30 in the peripheral direction are repeated. By a repetition of the above-stated steps, the outer peripheral portion of the material 10*b* moves into contact with the inner peripheral face of the female die 20. Accordingly, the drawing processing is carried out. The axial direction of the tool 30 is the drawing processing direction, while the moving direction of the tool 30 along the inner peripheral face of the female die 20 is in the radial direction of the tool 30.

By doing this, the material 10*b* is deformed in a narrow portion between the female die 20 and the tool 30 and only a small and uniform distortion is produced incrementally, so that the flatness of the bottom plate 11 is maintained satisfactorily.

Figure 3:
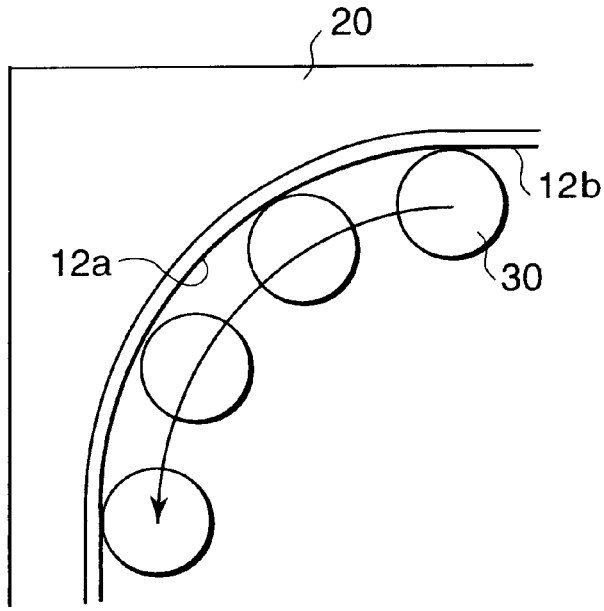
FIG. 3 is a plan view showing the processing condition of the circular arc portion shown in FIG. 1.

In addition to the above, since the molded product is formed by restricting the flange 12 over the entire periphery by the female die 20, a molded product in which the flange does not expand toward the outside and in which the perpendicularity between the flat plate portion and the flange portion is outstanding can be produced. Particularly, although the flange 12*a* at the corner has a tendency to be expanded toward the outside by the drawing processing, as shown in FIG. 3, the flange 12*a* is restricted from expanding toward the outside by the female die 20, so that the flange 12*a* becomes perpendicular. Namely, in all ranges from the first stage to the finish stage of the drawing processing, since the flange 12 is clamped between the inner peripheral face of the female die 20 and the side face of the tool 30, by restricting the flange 12 from the inner side and the outer side, the drawing processing can be carried out. As a result, a processing having a good perpendicularity etc. can be carried but. When the flange 12 is overlapped and welded to the end portion of a cylinder, the welding can be carried out easily.

As stated above, in the incremental forming of the molded product using the female die 20, the seat 40 is installed on the inner periphery side of the female die 20, and the material 10*b* is fixed to the seat 40, so that the material 10*b* can be fixed and a predetermined forming can be carried out. The same may be said for a case in which the forming progresses and the flange 12 is positioned on the perpendicular surface of the female die 20. Further, the end portion of the material 10*b* is moved into direct contact with the inner peripheral face of the female die 20 as the drawing processing is carried out. As a result, the perpendicularity between the flange 12 and the bottom face 11 can be formed accurately. Further, the height of the flange 12 can be large, and the reduction of the plate thickness of the flange 12 can be restrained.

Since the end portion of the material 10*b* is moved into the female die 20 as the drawing processing is carried out, when the shape into which the material 10*b* is to be formed is taken into the consideration, after the forming, it is unnecessary to cut off the end portion of the flange 12. Further, since the flange is fixed to the seat 40, the positioning thereof can be carried out with the guidance of the pins 23, etc.

Since a high load like a press forming is not required, the female die 20 may be made of a simple material, such as a general steel material, and does not require a heat treatment, such as hardening, and a minute surface finishing like a press die.

The processing machine for executing the incremental forming is a numerical control processing machine, for example, an NC milling machine or a machining center. On the main shaft (the spindle) of the numerical control processing machine, the tool 30 is installed. The main shaft is moved horizontally along the inner peripheral surface of the female die 20 and in the vertical direction into the female die 20 by numerical control. The numerical control processing machine shown in FIG. 1 is a longitudinal one. The main shaft carrying the tool 30 can be moved in the vertical direction and one way in the horizontal direction. The female die 20 and the seat 40 are mounted on a table (the base). The table can be moved in the horizontal direction perpendicular to the vertical direction of movement of the main shaft toward the female die 20. According to these two movements, the tool 30 can be moved along the inner peripheral face of the female die 20. The raising and lowering apparatus 50 is mounted on the table. In place of the vertical movement of the tool 30, the table can be moved up and down.

An example will be explained hereunder. The diameter of the tool 30 is 25 mm; the plate thickness of the material 10*b* is about 0.5 mm to 4 mm; the distance from the inner peripheral face of the female die 20 to the side face of the tool 30 is about 0.8 to 2 times the plate thickness; the incremental forced depth of the tool 30 per each revolution of the tool around the periphery of the die 20 (the distance the seat 40 moves per each processing step) is 0.5 to 2 times the plate thickness of the material 10*b*; and the height of the flange 12 is about 5 to 20 times the plate thickness of the material 10*b*. As a specific example, the height of the flange 12 is 20 mm; the radius of the circular arc portion (the shoulder portion) of the female die 20 is 5.5 to 13.5 mm; the diameter of the tool 33 is 25 mm; the radius of tip end of the tool 30 is 5.5 to 10 mm; and the radius of the circular arc portion 12*a* is 100 mm.

The size of the material 10*b* will be explained. As shown in FIG. 1, the material 10*b* has a size such that the end portion thereof is positioned on the upper shoulder portion of the female die 20 having a circular arc shape of radius R so that the edge of the material 10*b* is substantially aligned with the center of the shoulder portion of the female die 20 on the upper side thereof. When the size is larger than this, in the circular arc portion 12*a* of the flange, cracks can occur easily in the connection portion between the flange 12 and the bottom plate 11.

Figure 6:
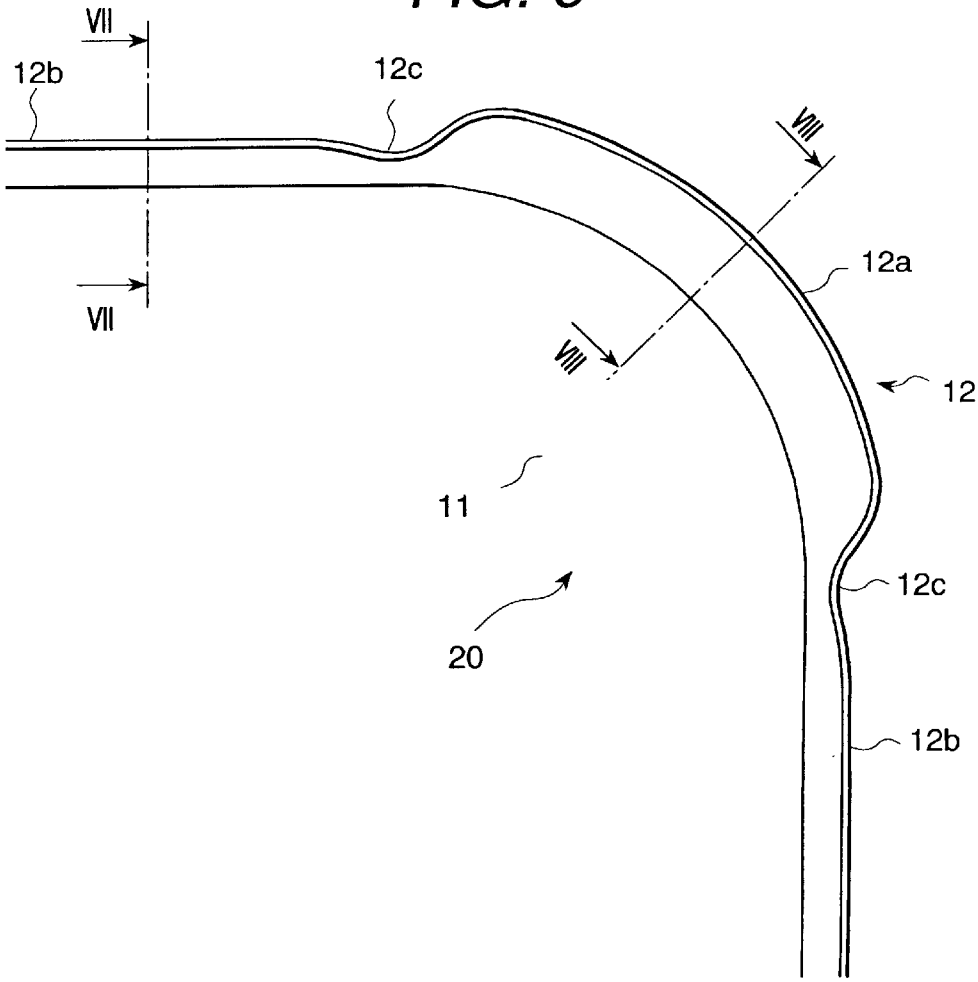
FIG. 6 is a plan view showing the circular arc portion of the molded product.
Figure 7:
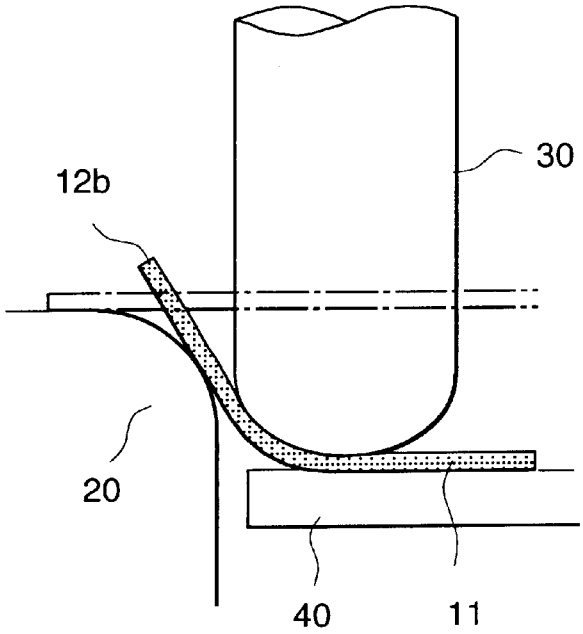
FIG. 7 is a cross-sectional view taken along line VII—VII of FIG. 6.
Figure 8:
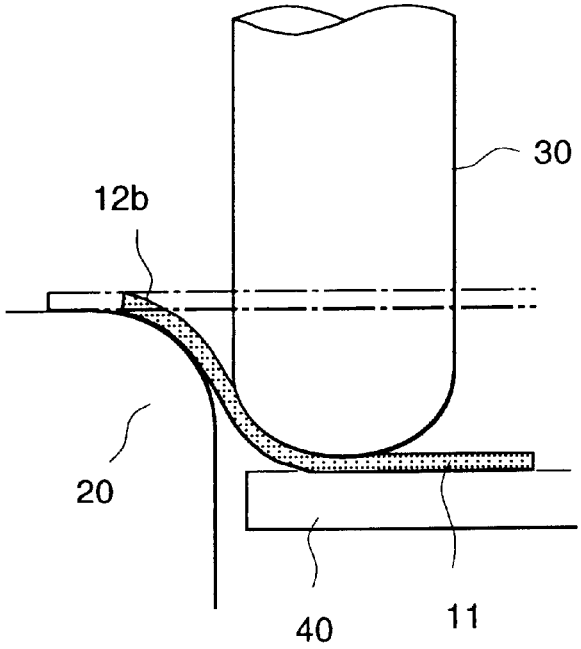
FIG. 8 is a cross-sectional view taken along line VIII—VIII of FIG. 6.

In this embodiment, as shown in FIG. 6, in the connection portion between the linear portion 12*b* and the circular arc portion 12*a* of the flange 12, a wrinkle 12*c* occurs easily. When the proportion of the height of the flange 12 becomes large, the wrinkle 12*c* occurs easily. In FIG. 6, so to be easily understand this problem, the wrinkle is shown with exaggeration. As shown in FIG. 7, during the drawing processing, the linear portion 12*b* of the flange 12 is inclined linearly from the bottom plate 11. As shown in FIG. 8, during the drawing processing, the circular arc portion 12*b* of the flange 12 is in contact along the circular arc of the shoulder portion of the female die 20. Therefore, when the wrinkle 12*c* begins to occur during the progression of the drawing processing, the drawing processing is stopped, and at the circular arc portion of the female die 20, a process for restraining the wrinkle and for smoothing the flange 12 is carried out. Hereinafter, this process will be explained with reference to FIG. 9A to FIG. 9C.

Figure 9A:
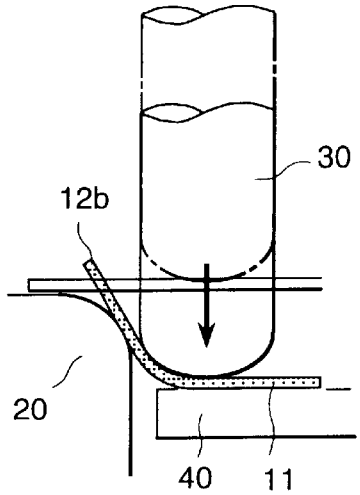
FIGS. 9A to 9C are longitudinal cross-sectional views showing successive steps of a drawing processing according to another embodiment of the present invention.
Figure 9B:
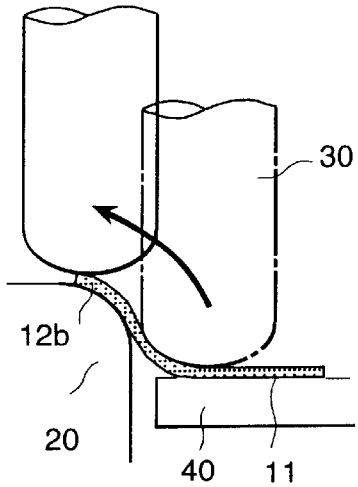
Figure 9C:
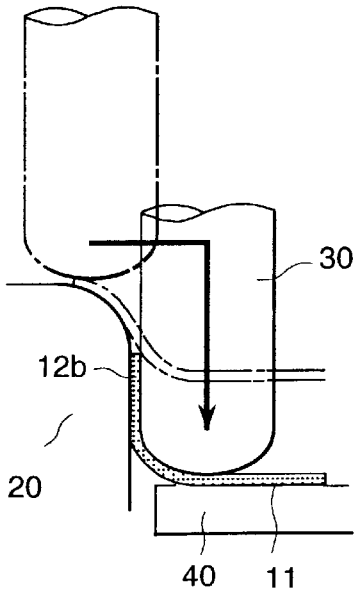

When the processing reaches the stage at which a wrinkle 12*c* occurs, the drawing process shown in FIG. 9A (namely FIG. 1) is stopped, and then the lowering of the seat 40 is stopped. And, as shown in FIG. 9B, the tool 30 is moved up slightly and slightly toward the outside of the female die 20. Namely, under the condition where the material 10*b* is clamped to the circular arc shaped portion of the shoulder of the female die 20 by the tool 30, the tool 30 is moved around the periphery of the die 20. This operation is carried out several times with the tool 30 being moved upward and outward incrementally each time. Next, as shown in FIG. 9C, the tool 30 is made to return to the position of FIG. 9A (namely, FIG. 1), and the drawing processing of FIG. 9A (namely, FIG. 1) is restarted. Namely, the seat 40 and the tool 30 are moved down and the tool 30 is moved horizontally around the die 30 once again. After the restart of the drawing processing, it the wrinkle 12 begins to occur again, the above-stated wrinkle restraining process is restarted.

By determining when a wrinkle typically begins to occur during the drawing processing from experimentation, in the course of the drawing processing, the wrinkle restraining process can be built-in in advance. By summing up the extent of lowering of the seat 40 and the tool 30 and effecting one round of the tool 30 in the peripheral direction of the female die 20, a one time drawing process can be constituted.

In the above-stated embodiment, after the seat 40 has moved down, the tool 30 is then moved down. However, they may be moved down at the same time. Further, it may be unnecessary to make the tip end of the tool flat, and also it may be unnecessary to rotate the tool 30.

In the above-stated embodiment, the diameter of the tool 30 is uniform. Therefore, until immediately before the completion of the forming processing, the tip end portion of the flange 12 is in contact with the side of the tool 30. The tip end portion of the flange 12 comes in contact with the side of the tool 30 during every revolution of the tool 30. When a failure occurs due to such contact, the diameter of the tool 30 at the position which is opposite to the tip end portion of the flange 12 is reduced.

In the above-stated embodiment, the incremental forming is performed in a state in which the tool 30 and the seat 40 clamp the material. However, incremental forming in the clamped state is not necessary. Therefore, at a desired point of time, the distance through which the seat 40 is lowered can be made longer than the distance through which the tool 30 is lowered. In this way, an interval larger than the plate thickness of the material 10*b* is established between them. Thereafter, the two are moved down while this interval is maintained. At the last stage of the drawing processing, the tool 30 and the seat 40 are moved down so as to clamp the bottom plate 11 with the tip end portion of the tool 30 and the seat 40. In the this clamped state, the tool 30 is moved in the peripheral direction around the die 20.

According to this method, during the incremental forming, the outer periphery of the bottom plate 11 is not clamped by the seat 40 and the tip end of the tool 30. Therefore, the plate is not partially made thinner. The bottom plate 11 is fixed to the seat 40 in a bent state. At the final stage, the seat 40 and the tip end of the tool 30 clamp the bottom plate 11 and the incremental forming is carried out, so that the flatness of the bottom plate 11 and the angle between the bottom face 11 and the flange 12 are set as specified.

In an alternative arrangement, the seat 40 is fixed, and the female die 20 is moved up as the drawing processing is carried out. In such an arrangement, the tool 30 does not move vertically during the forming processing. The seat 40 is positioned in relation to the axial direction of the tool 30 and along the inner peripheral face of the female die 20. In the embodiment shown in FIG. 1, the vertical load produced by the tool 30 is applied to the seat 40 (the raising and lowering device 50), and the seat 40 (45) moves in the vertical direction. As a result, the seat 40 (45) is inclined easily and moves down easily from a predetermined position in response to this load. For this reason, it is hard to produce a molded product with high accuracy. To prevent this, it is necessary to constitute the raising and lowering device 50 which supports the seat 40 so that it is strong, with the result that the apparatus becomes high in cost. However, the tool 30 hardly adds vertical load to the female die 20. For this reason, when the female die 20 is made to move, rather than moving the seat 40, the above stated problems hardly occur, so that a molded product having a high accuracy can be produced and the apparatus can be manufactured with a low cost. In this case, during the time the female die 20 is made to move, it can stop the movement of the tool 30. Thus, during the time the female die 20 is made to move or before of this, the tool 30 is moved up, and after the raising of the female die 20, the tool 30 is moved down again.

Figure 10:
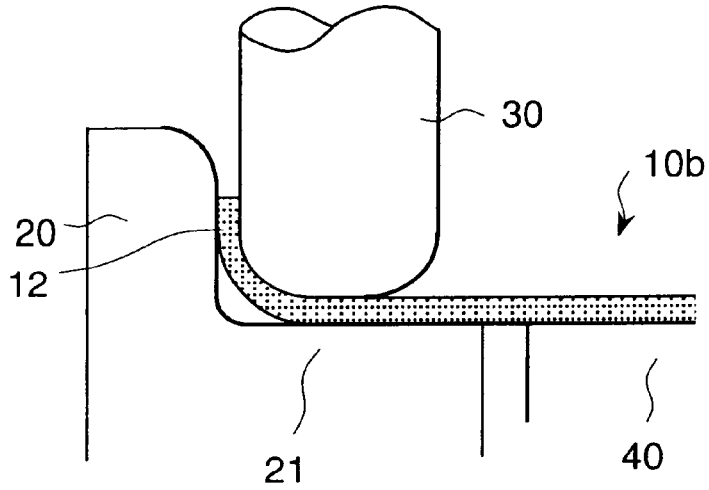
FIG. 10 is a longitudinal cross-sectional view of the essential section of another embodiment according to the present invention.

The embodiment shown in FIG. 10 will be explained hereinafter. In this embodiment, the female die 20 has a bottom portion 21. The width of the bottom portion 21 is equivalent to the diameter of the tool 30. When the tool 30 moves down to the lowest end position, the tip end of the tool 30 and the tip end of the bottom portion 21 clamp the material 10*b*. The diameter of the seat 40 is smaller than the inner diameter of the bottom portion 21. The lowering distance of the tool 30 is practically the same as that of the seat 40. The lowering distance of the seat 40 is controlled so that the bottom plate 11 of the material 10*b* will not be deformed. At the final stage of the drawing processing, the height position of the seat 40 is adjusted to the height position of the bottom portion 21. In the state in which the tip end of the tool 30 and the bottom portion 21 clamp the material 10*b*, the tool 30 is moved along the inner peripheral direction of the female die 20. According to this, it is sufficient to manufacture only the female die 20 so as to withstand the drawing processing load of the tool 30.

When the size of the outer peripheral portion of the seat 40 is provided larger than the size of the inner peripheral portion of the bottom portion 21 of the female die 20, and when the seat 40 is moved down to the lowest end position, the outer peripheral portion of the seat 40 contacts on the bottom portion 21 of the female die 20. According to this, in the final processing stage, the seat 40 is supported by the female die 20, which is not moved, so that occurrence of the above-stated problems can be restrained. Further, the material 10*b* can always be clamped by the seat 40 and the tool 30.

When the seat is fixed and the female die 20 is moved, as in the above-described alternative arrangement, the seat 40 is provided in the axial direction of the tool 30 and along the peripheral direction of the peripheral face of the female die 20. When the female die 20 is raised to the most upper end position, the material 10*b* is clamped between the outer peripheral portion of the seat 40 and the tool 30. According to this, in the final processing stage, the material 10*b* is supported by the seat 40, which is not moved, so that occurrence of the above-stated problems can be restrained.

Figure 11:
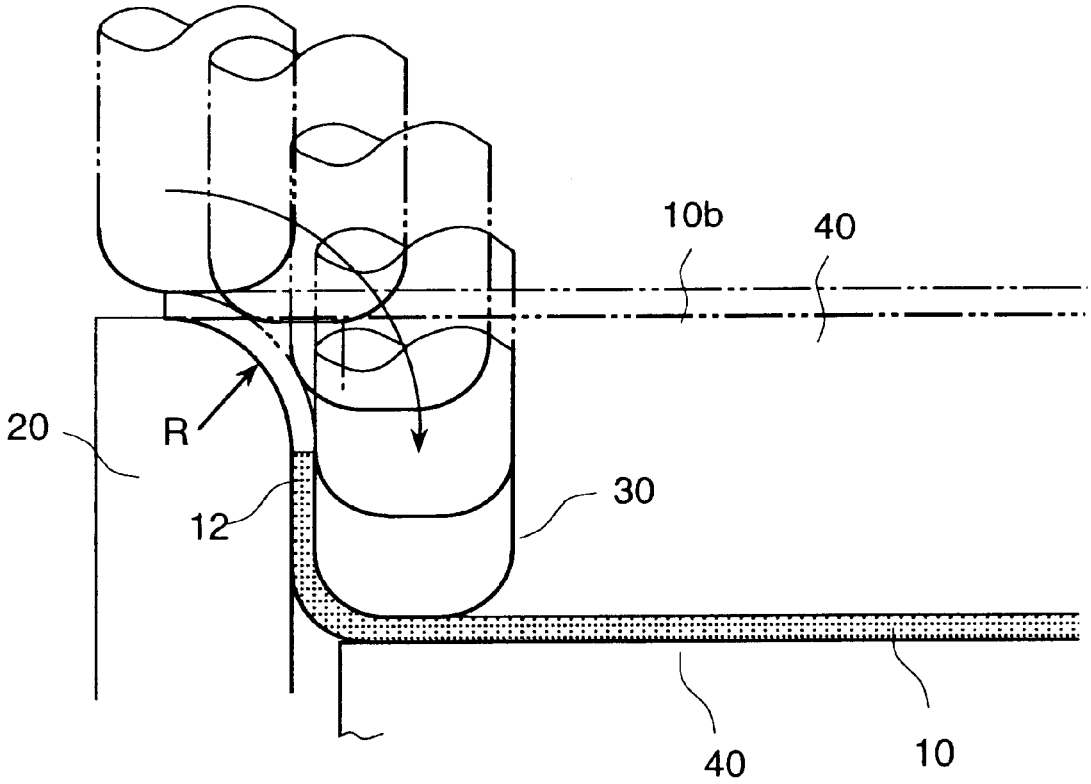
FIG. 11 is a longitudinal cross-sectional view of the essential section of still another embodiment according to the present invention.

The embodiment shown in FIG. 11 will be explained hereinafter. In this embodiment, the height of the flange 12 in the previous embodiment is increased. The movement of the seat 40 and the lowering of the tool 30 are the same as those shown in the previous embodiment. Only the differences between the embodiments will be explained hereinafter.

The circular arc of the shoulder portion of the female die 20 on the inner peripheral face side is comparatively large. The circular arc is expanded upward. The material 10*b* is mounted on the female die 20 and is fixed to the seat 40. The movement of the tool 30 will be explained mainly. Namely, when the outer end portion of the material 10*b* is mounted on the female die 20, in the state in which the outer portion of the material 10*b* is clamped between the circular arc portion of the female die 20 and the tip end portion of the tool 30, the tool 30 is moved in the peripheral direction of the female die 20. When it makes one round, the tool 30 is moved on the inner peripheral face side downward along the circular arc portion of the female die 20. In the state in which the material 10*b* is clamped between the circular arc portion of the female die 20 and the tip end portion of the tool 30, the tool 30 is moved in the peripheral direction of the female die 20. In the same way as with the embodiment shown in FIG. 1, when the tool 30 is to be moved down, the seat 40 is also moved down.

When the tool 30 passes along the circular arc portion of the female die 20*b* in this way, the tool 30 is positioned at the same location as that of the embodiment shown in FIG. 1. Namely, in the state in which the material 10*b* is positioned between the side face of the tool 30 and the inner peripheral face of the female die 20, the tool 30 is moved in the peripheral direction of the female die 20. The incremental operations carried out thereafter are the same as those of the embodiment shown in FIG. 1.

Namely, by pressing by the tip end of the tool 30 against the outer periphery of the material 10*b* mounted on the shoulder of the female die 20, the tool 30 is moved along the circular arc of radius R from the upper surface of the female die 20 to the inner peripheral face thereof until the material 10*b* is positioned between the vertical face of the female die 20 and the side face of the tool 30. This movement is carried out by numerical control.

By doing this, the outer peripheral portion of the material 10*b* is formed by fitting it to the circular arc shape of the shoulder of the female die 20, so that wrinkles are suppressed and drawing forming with a high flange can be realized. Particularly, when the corner portion 12*a* of the flange 12 is to be formed, it can be formed while preventing wrinkles from being generated.

Figure 12:
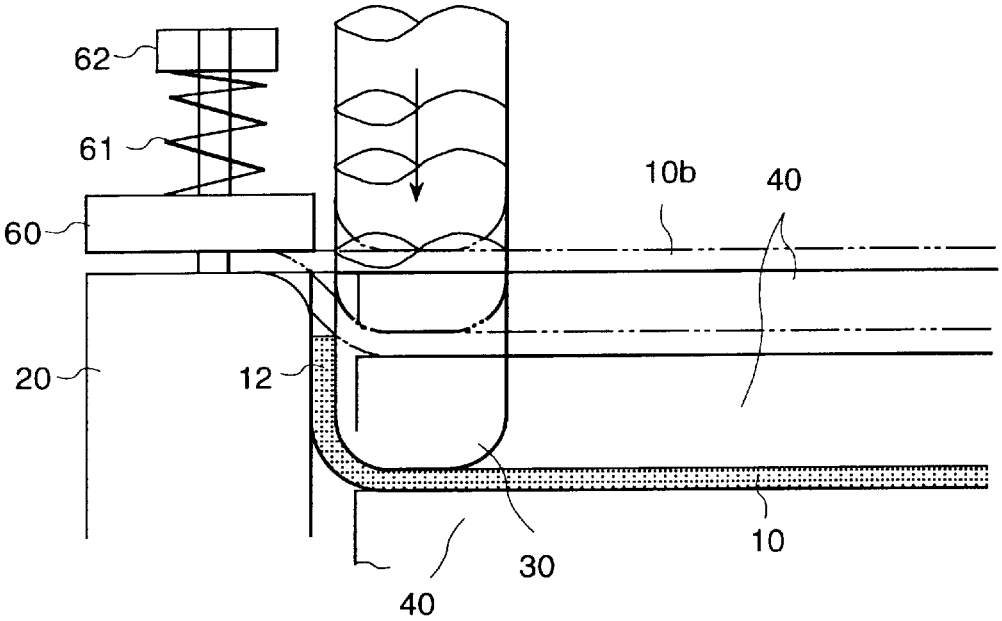
FIG. 12 is a longitudinal cross-sectional view of the essential section of a forming apparatus of another embodiment according to the present invention.

The embodiment shown in FIG. 12 will be explained hereinafter. A press seat 60 for biasing the outer peripheral portion of the material 10*b* against the female die 20 is provided. A coil spring 61 between the bolt 62 and the seat 60 presses the press seat 60 toward the female die 20. In this state, the incremental forming is carried out in the same way as with the embodiment shown in FIG. 1. The press seat 60 presses the outer periphery of the material 10*b* against the shoulder of the female die 20 so as to cause the tip end portion of the material 10*b* to move against the inner peripheral side of the female die 20. In this regard, as the drawing depth increases, the outer peripheral portion of the material 10*b* moves out from the press seat 60 and is released therefrom, so that the end portion of the material 10*b* is positioned against the inner peripheral face of the female die 20.

Figure 13:
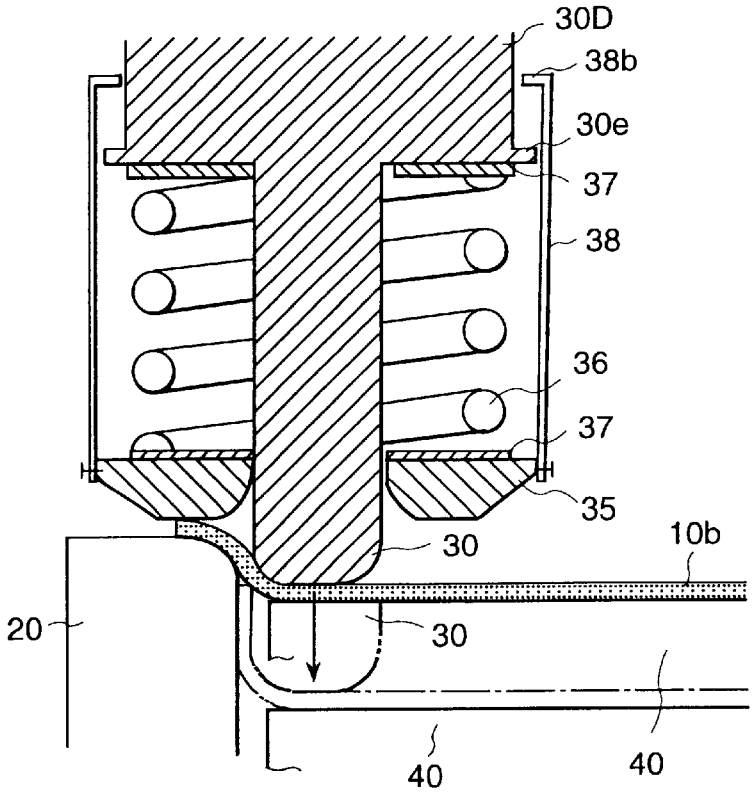
FIG. 13 is a longitudinal cross-sectional view of the essential section of a forming apparatus of still another embodiment according to the present invention.

The embodiment shown in FIG. 13 will be explained hereinafter. The tool 30 has a ring 35 for performing an operation equivalent to that of the press seat 60 of FIG. 12. The outer diameter of the ring 35 is larger than the outer diameter of the tool 30. The ring 35 is pressed downward by a coil spring 36, thus the ring 35 can move in the axial direction of the tool 30. Numeral 38 indicates a cylindrical member fixed to the ring 35 so as to prevent the ring 35, etc. from falling out. A guard 38*b* at the tip end of the member 38 is structured so as to engage a guard 30*e* of a large diameter portion 30D of the tool 30. Numeral 37 indicates a seat. The position of the tool 30 during the drawing processing is the same as that of the embodiment shown in FIG. 1.

According to this construction, in the early stage of forming, the ring 35 presses the outer peripheral portion of the material 10*b* against the arc-shaped surface of the female die 20. Therefore, the outer peripheral portion of the material 10*b* is fit to the circular arc portion on the shoulder of the female die 20. As a result, the generation of wrinkles is suppressed, and drawing forming with a high height flange can be realized.

Figure 14:
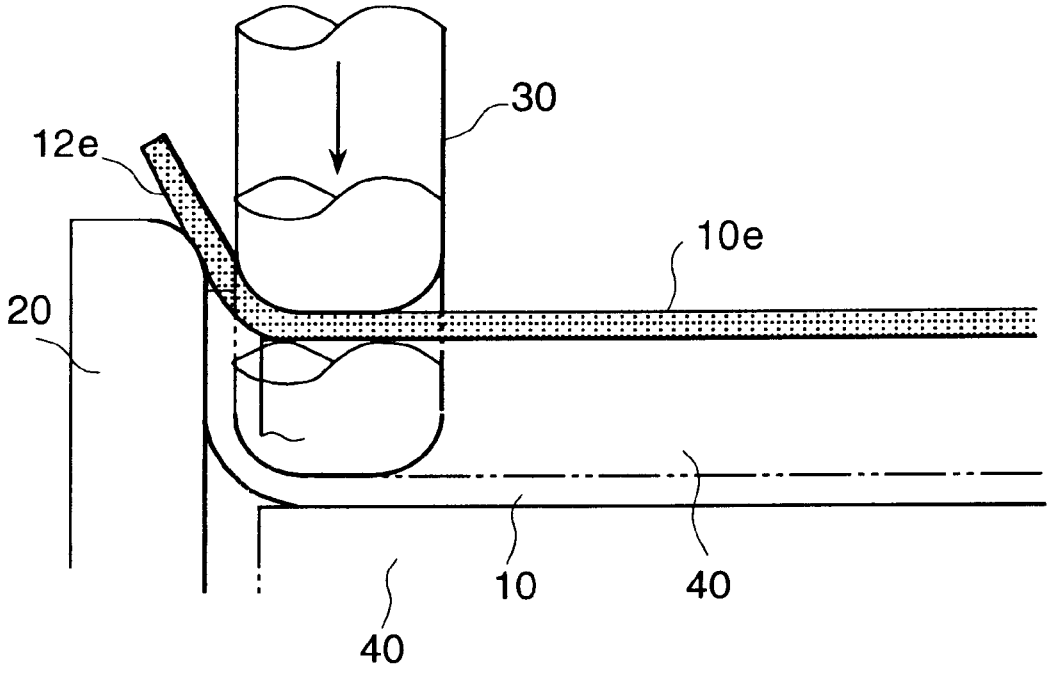
FIG. 14 is a longitudinal cross-sectional view of the essential section of a further embodiment according to the present invention.

The embodiment shown in FIG. 14 will be explained hereunder. The material 10*e* is a preformed material which is formed in advance to have a shape approximated to the target shape to be obtained by incremental forming. A flange 12*e* of the outer peripheral portion of the preformed material 10*e* is expanded upward in a bugle shape. In the early stage of processing, the flange 12*e* is in contact with the circular arc-shaped portion of the female die 20 at the upper end. The position of the tool 30 is the same as that of the embodiment shown in FIG. 1.

The flange 12*e* having the length finally required is inclined and installed in advance, so that the generation of wrinkles and the cracking of the plate of the incrementally formed portion can be prevented. The preformed material 10*e* is manufactured by press forming or incremental forming.

Figure 15:
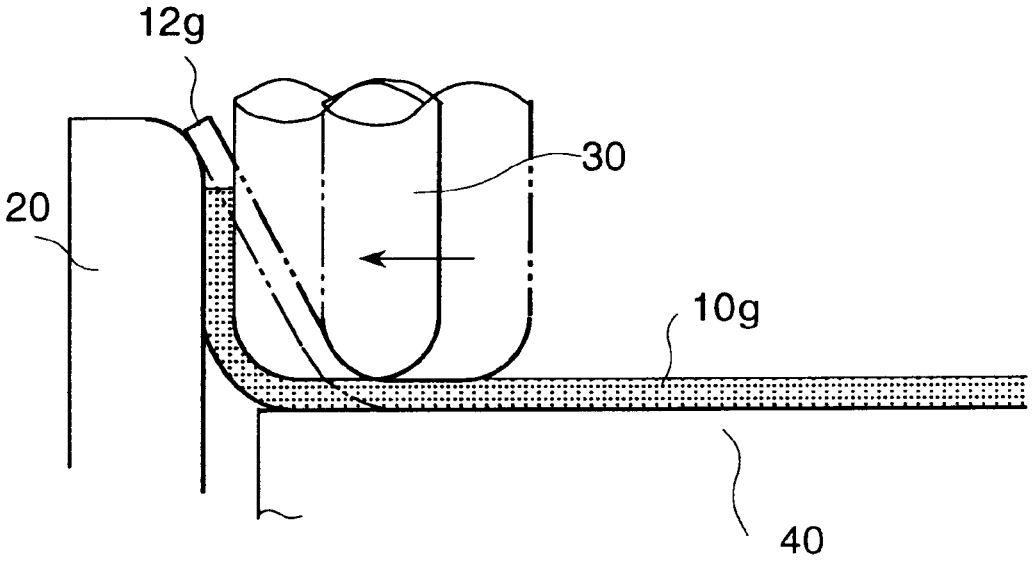
FIG. 15 is a longitudinal cross-sectional view of the essential section of a still further embodiment according to the present invention.

The embodiment shown in FIG. 15 will be explained hereunder. The material 10*g* is preformed so that the outermost peripheral portion almost coincides with the inner peripheral face of the female die 20. The flange 12*g* is expanded in a bugle shape. The tip end portion of the flange 12*g* is mounted on the circular arc-shaped portion of the female die 20. The preformed material 10*g* is mounted and fixed on the seat 40. The tip end of the tool 30 is lowered into contact with the bottom plate of the material 10*g*. The bottom plate of the material 10*g* is clamped between the tip end of the tool 30 and the seat 40. The side face of the tip end of the tool 30 is positioned on the boundary between the bottom plate of the material 10*g* and the flange 12*g*.

In this state, the tool 30 is moved horizontally toward the vertical side face of the female die 20 by an incremental amount, and then it is moved horizontally in the peripheral direction along the vertical face of the female die 20. Namely, the tool 30 makes one round so as to press and expand the flange portion on the outer periphery side. In every round, the gap with the female die 20 is narrowed to about 0.5 to 2 times of the plate thickness. The seat 40 does not move down.

The preformed material 10*g* can be manufactured by incremental forming as provided in the embodiment shown in FIG. 1. Then, it can be incrementally formed continuously as provided in the embodiment shown in FIG. 14 or FIG. 15.

Figure 16:
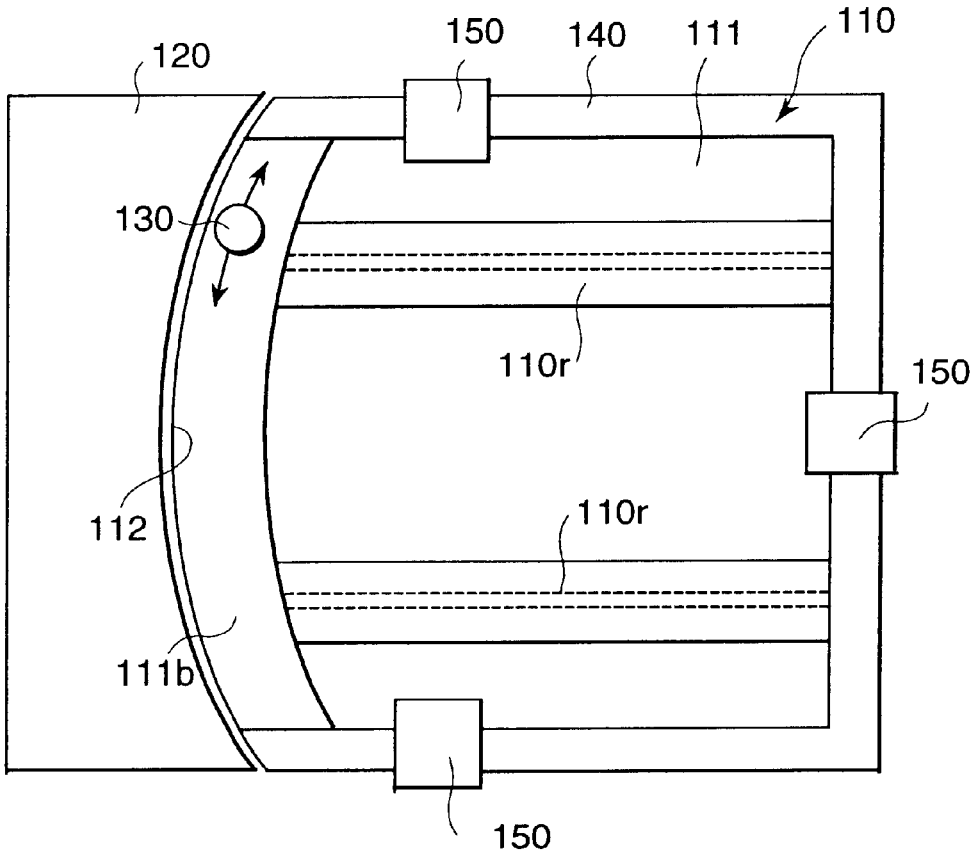
FIG. 16 is a plan view of the essential section of a further embodiment according to the present invention.
Figure 17:
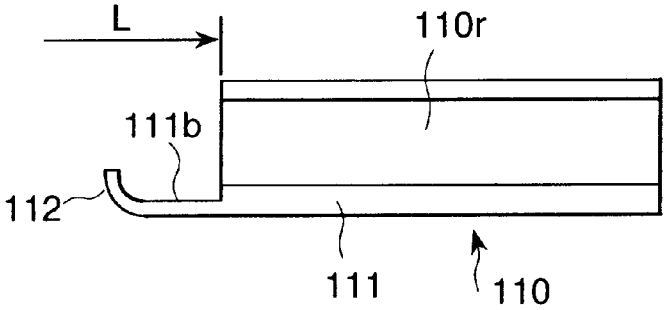
FIG. 17 is a side view of the material after forming by the apparatus shown in FIG. 16.

The embodiment shown in FIG. 16 and FIG. 17 will be explained hereunder. A flange 112 in this embodiment is provided only on one side of a substantially four-sided member. Such a flange is not provided over the entire outer peripheral portion of material 110. The side on which the flange 112 is provided is circular arc shaped. The material 110 is an extruded frame member made of aluminum alloy and it has a rib 110*r* on the upper face side thereof. The rib has a T-shaped section.

The portion of the rib 110*r* where the flange 112 is to be installed is cut and removed beforehand. The thickness of the face plate 111 of the frame member 110 is generally thicker than the thickness suited to incremental forming, so that the portion of the face plate 111 where the flange 112 is to be installed is cut and formed as a thin plate 111*b*. This cutting is carried out, for example, by end milling. The cutting range L of each of the face plate 111 and the rib 110*r* is determined by the range of movement of a tool 130.

It is sufficient for the female die 120 to have only a length corresponding to that of the flange 112. Numeral 150 indicates a restricting metal member for clamping and fitting the face plate 111 of the frame member 110 onto the seat 140. The metal fitting member 150 clamps the face plate 111 of the frame member and the seat 140 in the upper and lower direction. When a hole may be formed in the face plate 111, it is clamped by a bolt and nut so as to be fixed to the seat 140.

The flange 112 is provided only at a part of the frame member, so that there is no need to rotate the rod shape metal fitting 130 around the inner peripheral face of the female die 120. It is sufficient for the rod shape metal fitting 130 to move back and forth in the direction of the arrow, as shown in FIG. 16. In both forward and backward reciprocating motions, the material can be incrementally formed. To the four-sided shaped material, the flange to be incrementally formed can be processed in a case where a flange exists on three sides and the two opposed sides.

Figure 18:
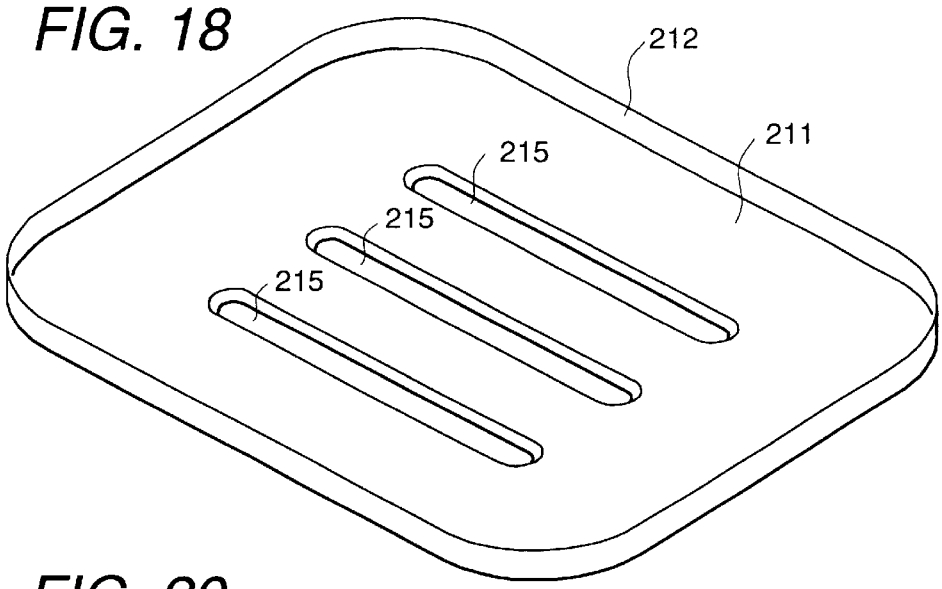
FIG. 18 is a perspective view of the molded product of another embodiment according to the present invention.

The embodiment shown in FIG. 18 will be explained. As shown in FIG. 18, a molded product 210 of this embodiment has a flange 212 around the periphery of a bottom plate 211, and to the bottom plate 211, plural ribs 215 are provided. The bottom face of each rib 215 is comparatively wide. The flange 212 has a substantially four-sided shape with curved corners. The ribs 215 project in a direction opposite to that of the flange 212.

Figure 19A:
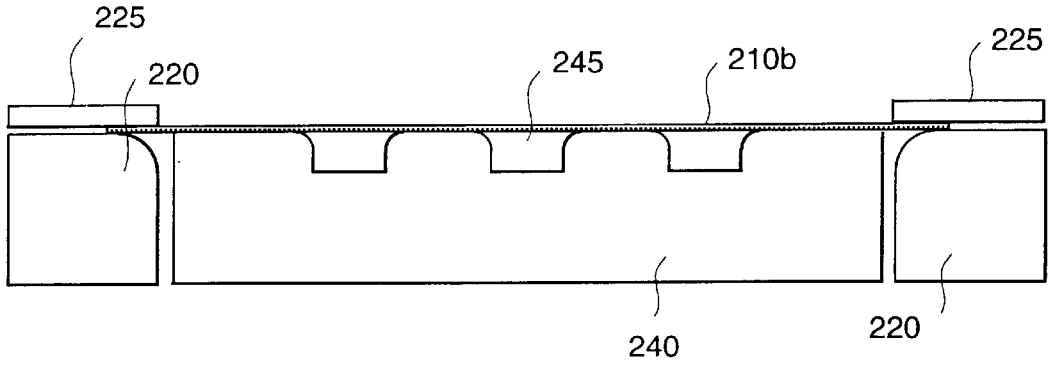
FIGS. 19A to 19D are cross-sectional views showing steps of a manufacturing process for production of the molded product of FIG. 18.

A manufacturing process for producing the molded product 210 will be explained with reference to FIGS. 19A to 19D. A flat plate 210*b* is mounted on a female die 220 and a seat (a die) 240, and the end portions of the four sides of the material 210*b* are pressed to the female die 220 by fitting metal members 225 so as to be fixed thereto. An upper face of the female die 220 and an upper face of the seat 240 are substantially at the same height. To an upper face of the seat 240, plural lines of recessed portions 245 having a size corresponding to the ribs 215 are provided. The depth of the recessed portion 245 is larger than the height of the rib 215 (FIG. 19A).

The tool 30 is moved to the position where a rib 215 is to be provided, and the tool 30 is moved down. Then, the tool 30 is moved horizontally along the periphery of the recessed portion 245 so that a rib is formed. This processing is sponson processing. When the tool 30 has completed one round along the periphery of the recessed portion 245, the tool 30 is moved to the position where another rib 215 is to be provided, and the sponson processing is carried out similarly. As a result, recesses for the ribs 215 are formed in order. In this processing, the amount by which the tool 30 is lowered is smaller than the height of the ribs 215.

Figure 19B:
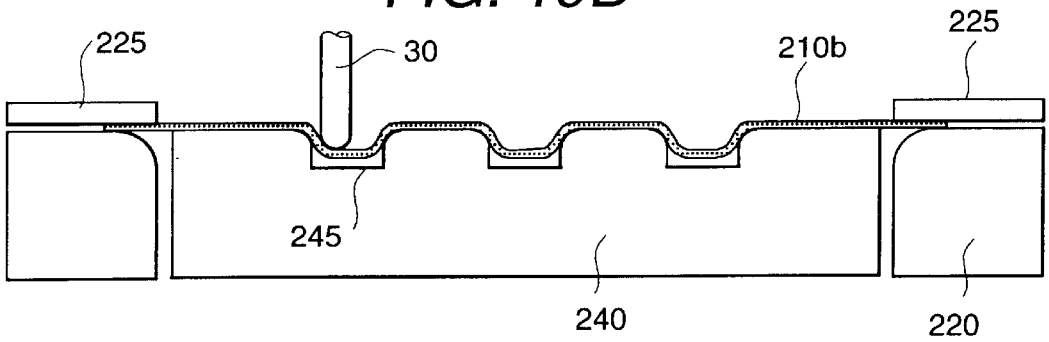

When the tool 30 has completed one round along the periphery of all of the recessed portions 245, the tool is moved down by an incremental amount and is moved along the periphery of the first recessed portion 245 once again. Similarly, at the position of another rib, the repeated drawing processing is carried out. This processing is repeated a necessary number of times. As stated above, all of the ribs are formed little by little in order (FIG. 19B).

Figure 19C:
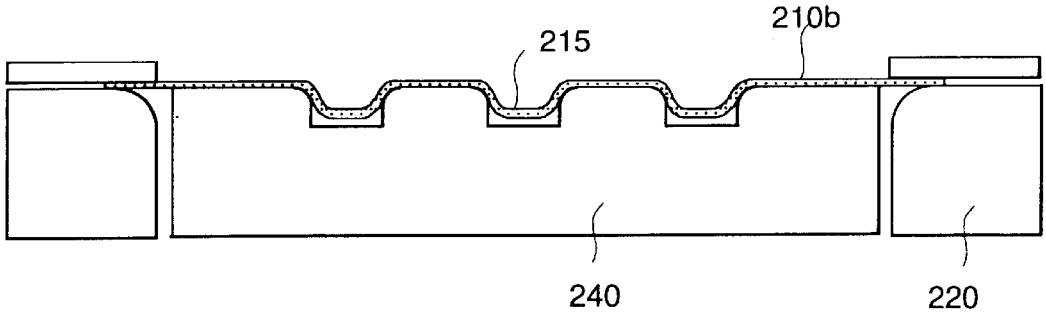

When a predetermined number of the ribs 215 have been formed, the metal fittings 225 are removed, and then the material 210*b* is fixed to the seat 240 by electromagnetic force or vacuum adsorption. (FIG. 19C)

Figure 19D:
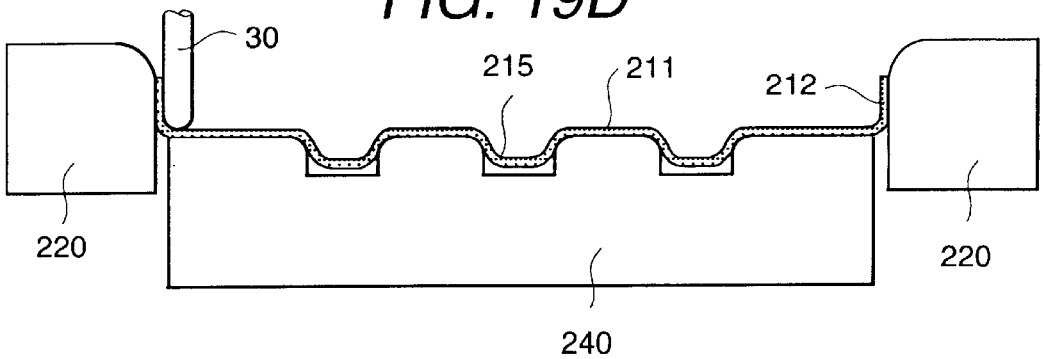

Next, the drawing processing for providing the flange 212 around the edge of the material 210*b* is carried out according to the movement of the tool 30 and the female die 220 (or the seat 240) similarly to the above-stated embodiments (FIG. 19D). When the molded product 210 is large, it is desirable to fix the seat 240 and move the female die 220.

The embodiment shown in FIG. 18 and FIG. 19 also can be utilized in a case where the flange is not provided, but the plural ribs 215 are provided. The material 210*b* may be fixed to the seat 240 during the forming of the ribs 215.

A case where the cross-sectional shape of the ribs 215 is a substantially triangular shape will be explained. The tool 30 is lowered such that a gap of more than the plate thickness is provided between the end portion of the recessed portion of the seat 240 and the side face of the tool 30. Further, a predetermined circular arc shape is given to the connection portion between the rib 215 and the bottom plate 211. In this embodiment, the flanges 212 are provided on four sides, but the flanges may be provided on only three sides.

Figure 20:
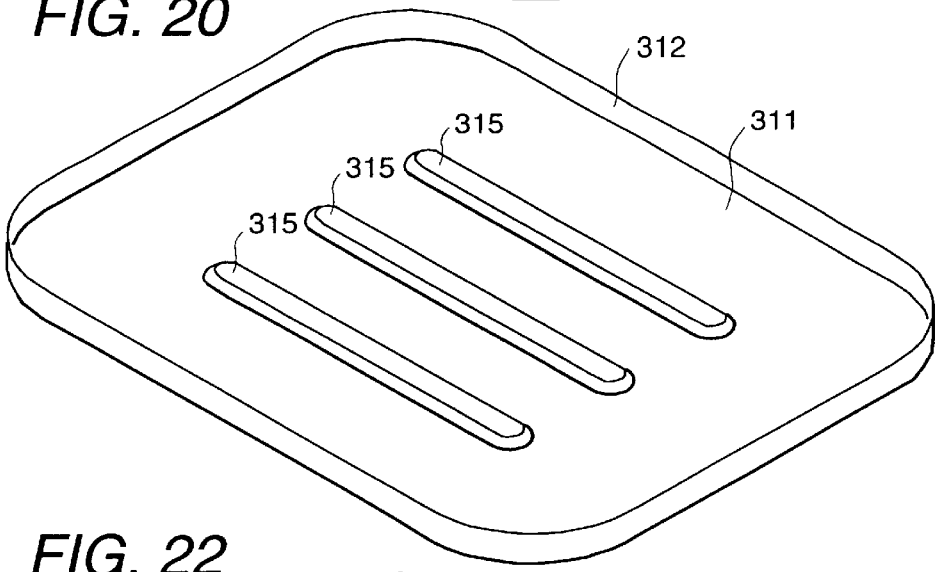
FIG. 20 is a perspective view of the molded product of a further embodiment according to the present invention.

The embodiment shown in FIG. 20 will be explained. As shown in FIG. 20, a molded product 310 of this embodiment has a flange 312 around the periphery of a bottom plate 311, and in the bottom plate 311, plural ribs 315 are provided. The bottom face of the ribs 315 is comparatively wide. The flange 312 has a substantially four-sided shape with curved corners. The ribs 315 project in the same direction as the direction of the flange 312.

Figure 21A:
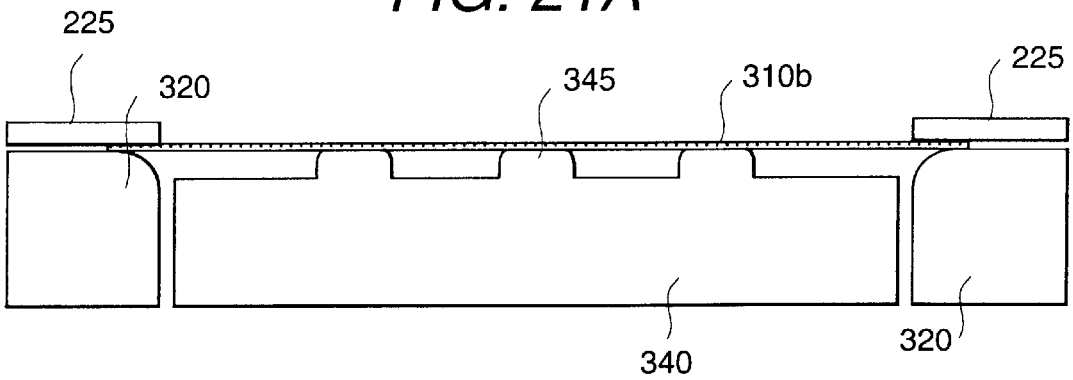
FIGS. 21A to 21D are cross-sectional views showing steps of a manufacturing process for production of the molded product of FIG. 20.

A manufacturing process for producing the molded product 310 will be explained with reference to FIGS. 21A to 21D. A flat plate 310*b* is mounted on a female die 320 and a seat (a die) 340, and the end portions of the four sides of the material 310*b* are pressed to the female die 320 by a fitting metal member 325 and so as to be fixed thereto. An upper face of the female die 320 and an upper face of the seat 340 are substantially at the same height. To an upper face of the seat 340, plural lines of raised portions 345 having a size corresponding to the ribs 315 are provided. The size (width, length, height) of the raised portions 345 is substantially same as the size of the ribs 315 (FIG. 21A).

The tool 30 is moved to the position where a rib 315 is to be provided and the tip end of the tool 30 is placed in contact with the upper face of the material 310*b*. The tool 30 and the female die 320 are then moved down, the tool 30 is moved horizontally along the periphery of the raised portion 345 so that a rib is formed. This processing is sponson processing. When the tool 30 has completed one round along the periphery of the raised portion 345, the tool 30 is moved to the position where another rib 315 is to be provided, and the sponson processing is carried out similarly. As a result, projections for the ribs 315 are formed in order. In this processing, the amount by which the tool 30 is lowered smaller than the height of the ribs 315.

Figure 21B:
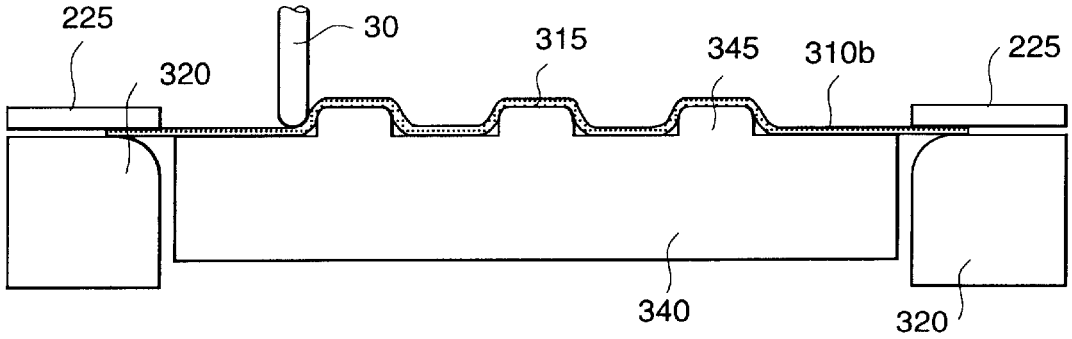

When the tool 30 has completed one round along the periphery of all of the raised portions 345, the tool is moved down by an incremental amount and is moved along the periphery of the first raised portion 345 once again. Similarly, at the position of another rib, the repeated drawing processing is carried out. This processing is repeated a necessary number of times. As stated above, all of the ribs are formed little by little in order (FIG. 21B).

Figure 21C:
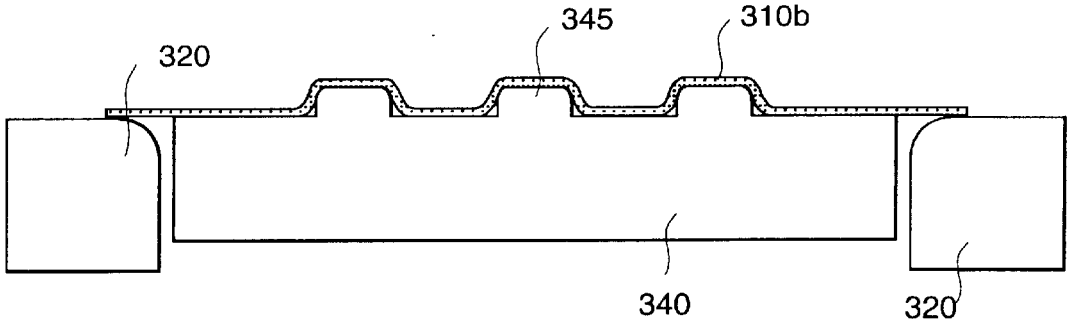

When a predetermined number of the ribs 315 have been formed, the metal fittings 225 are removed, and then the material 210*b* is fixed to the seat 240 by electromagnetic force or vacuum adsorption. (FIG. 21C)

Figure 21D:
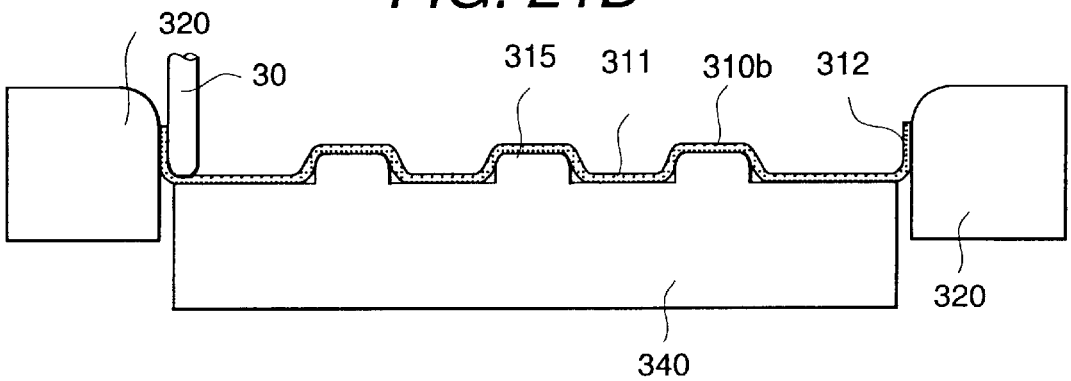

Next, the drawing processing for providing the flange 312 around the edge of the material 310*b* is carried out according to the movement of the tool 30 and the female die 320 (or the seat 340) similarly to the above-stated embodiments (FIG. 21D). Since in the formation of the raised portions 345, the female die 320 is moved, in a case of the formation of the flange 312, since the female die 320 is moved, the constitution can be made simply.

The embodiment shown in FIG. 20 and FIG. 21 also can be utilized in a case where the flange is not provided, but the plural ribs 315 are provided.

Figure 22:
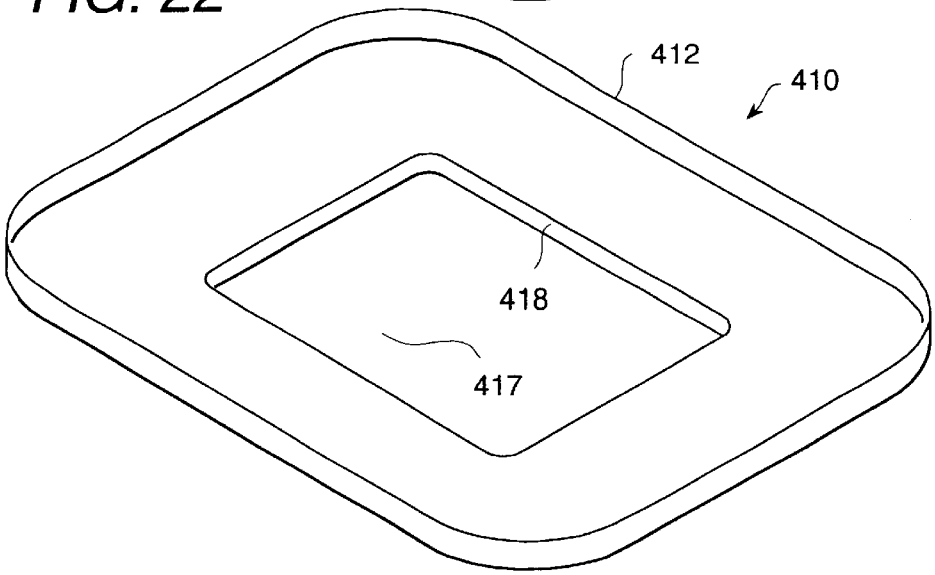
FIG. 22 is a perspective view of the molded product of a further embodiment according to the present invention.

The embodiment shown in FIG. 22 will be explained. In this embodiment, a burring 418 is provided at a surrounding portion of a hole 417 of a molded product 410. The direction of projection of the burring 418 is opposite to the direction of projection of a flange 412 on the outer peripheral portion of the molded product 410. To a material in which the burring 418 on the hole 417 is provided, a burring processing is carried out. The processing procedure is similar to that described with reference to FIGS. 19A to 19D. The recessed portion 245 becomes the burring 418. A case of the provision of plural burrings is similar.

When the projection direction of the burring and the projection direction of the flange 412 of the outer peripheral portion of the molded product are the same, procedure similar to that of FIGS. 21A to 21D is carried out. The raised portion 345 becomes the burring. A case of the provision of plural burring is similar.

The invention can be applied such that the female die is provided with the vacuum adsorption pad and the electromagnet; and, in such case, the material is fixed to the die, and along the outer periphery of the material, the incremental processing is carried out using the tool.

The technical scope of the present invention is not limited to the described embodiments or the description of the means of solving the problems of the prior art, but is applicable to a range of equivalents which is easily recognized by those who are skilled in the art to which the present invention is directed.

According to the present invention, in a method for incrementally forming a product using a female die and a tool, the product can be easily formed to have a predetermined shape.

What is claimed is:

1. An incremental forming method, wherein under a condition where a material is fixed to a seat arranged on an inner side of a female die, between said female die and a tool member and between said seat and said tool member, said material is arranged, and under a condition where an outer end portion of said material is capable to move in a drawing processing direction;

said seat and said tool member are relatively moved in said female die according to a drawing processing direction; and said tool member is relatively moved along to an inner peripheral face of said female die.

2. An incremental forming method according to claim 1, wherein after said tool member has relatively moved along to said inner peripheral face of said female die;

said seat and said tool member are relatively moved to said female die in said drawing processing direction; and said tool member is relatively moved along to said inner peripheral face of said female die.

3. An incremental forming method according to claim 1, wherein said tool member is moved to said drawing processing direction and an outer end portion of said material is moved to an inner side of said female die.

4. An incremental forming method according to claim 1, wherein said tool member is moved in said drawing processing direction and an outer end portion of said material is moved from an end face of said female die to said inner peripheral face of said female die.

5. An incremental forming method according to claim 1, wherein, said tool member is a rod-shaped tool member which is elongated in a moving direction of said seat and has a uniform diameter;

said inner peripheral face of said female die has a parallel face in a drawing descending direction from a vicinity of a start end of said drawing processing to a finish end thereof; and under a condition where said material is sandwiched between a side face of said rod-shaped tool member and said inner peripheral face of said female die, said tool member is relatively moved along said inner peripheral face of said female die.

6. An incremental forming method according to claim 5, wherein said seat is arranged in an axial direction of said tool member;

said tool member and said seat are moved to form a gap between a tip end of said tool member and said material;

under a condition where said material is sandwiched between said side face of said tool member and said inner peripheral face of said female die, said tool member is relatively moved in said drawing processing direction;

under a final stage of said drawing processing said tip end of said tool member is contacted to said material; and under a condition where said material is sandwiched between said tip end of said tool member and said inner peripheral face of said female die, said tool member is moved along said inner periphery face of said female die.

7. An incremental forming method according to claim 5, wherein after said movement of said seat and said tool member in said drawing processing direction has been carried out and after a movement of said tool member in said inner peripheral face of said female die has been carried out, said drawing processing is interrupted; and said tool member is relatively moved in a side of said circular arc portion, and between said circular arc portion and a tip end of said tool member, said material is clamped; under said above stated condition, said tool member is relatively moved along to said inner peripheral face of said female die; and said tool member is relatively returned in said interrupted portion and said drawing processing is restarted.

8. An incremental forming method according to claim 7, wherein under a condition where between said circular arc portion and said tip end of said tool member said material is clamped, after said tool member has relatively moved along to said inner peripheral face of said female die;

to said circular arc portion arranged in an outer side of said position said tool member is made to relatively move, between said tip end of said tool member and said circular arc portion, said material is clamped; and under said above stated condition, said tool member is relatively moved along to said inner peripheral face of said female die; and said tool member is relatively returned in said interrupted portion and said drawing processing is restarted.

9. An incremental forming method according to claim 5, wherein said seat is arranged in a lower portion of said tool member;

in a final stage of said drawing processing, under a condition where said seat is mounted on an inner side portion of said female die and also under a condition where, between said tip end of said tool member and said seat, said material is clamped, said tool member is moved along to said inner peripheral face of said female die.

10. An incremental forming method according to claim 5, wherein:

under a condition where said rod-shaped tool member is positioned in a finish end of said drawing processing, said material is sandwiched between a tip end of said rod-shaped tool member and a bottom face of said female die; and under this condition, where said material is sandwiched between said inner peripheral face of said female die and said side face of said tool member, said tool member is relatively moved along said inner peripheral face of said female die.

11. An incremental forming method according to claim 5, wherein said material is sandwiched between a tip end of said rod-shaped tool member and said seat; and under this condition where said material is sandwiched between said inner peripheral face of said female die and said side face of said tool member, said tool member is relatively moved along said inner peripheral face of said female die.

12. An incremental forming method according to claim 1, wherein said material is substantially a four-sided plate, and a corner portion or one side of said material is a circular arc shape plate.

13. An incremental forming method according to claim 1, wherein a guide which is arranged vertically in a start end of said drawing processing;

under a condition where said outer end portion of said material is contacted to said guide, said material is mounted on said female die; and said material is fixed to said seat.

14. An incremental forming method according to claim 1, wherein said material is fixed only to said seat.

15. An incremental forming method according to claim 1, wherein under a condition where said material is sandwiched between a side face of said tool member and said inner peripheral face of said female die said, tool member is relatively moved in said drawing processing direction; and under a condition where said material is sandwiched between a tip end of said tool member and said female die or said seat, along to said inner peripheral face of said female die said tool member is relatively moved.

16. An incremental forming method according to claim 1, wherein in said movement of said seat and said tool member, said seat is relatively moved in said drawing processing direction; and said tool member is relatively moved in said drawing processing direction.

17. An incremental forming method according to claim 1, wherein said seat and said tool member are relatively moved at the same time in said drawing processing direction.

18. An incremental forming method according to claim 1, wherein said female die is moved in said drawing processing direction.

19. An increment al forming method according to claim 1, wherein under a condition where between a circular arc portion of a shoulder portion of said female die and said tool member an outer end portion of said material is positioned, said tool member is relatively moved along to a peripheral direction of said female die;

said seat is relatively moved to said drawing processing direction and said tool member is relatively moved in said drawing processing direction along to said circular arc portion; and in said circular arc portion, said tool member is relatively moved along to a peripheral direction of said female die.

20. An incremental forming method according to claim 19, wherein according to said movement of said seat and said tool member, a tip end of said tool member passes through said circular arc portion, between a side face of said tool member and an inner peripheral face of a linear portion of said female die said material is positioned, said tool member is relatively moved along to said inner peripheral face of said female die.

21. An incremental forming method according to claim 1, wherein under a condition where an outer end portion of said material is constrained to one end portion of said female die, said tool member is relatively moved along to said inner peripheral portion of said female die; and under a condition where in correspondence with a relative movement of said seat and said tool member to said female die in said drawing processing direction, and under a condition where between a side face of said tool member and said inner peripheral face of said female die said outer end portion of said female die is positioned, said tool member is moved along to said inner peripheral face of said female die.

22. An incremental forming method according to claim 21, wherein said restriction is carried out by fixing a restriction tool member to said one end portion of said female die.

23. An incremental forming method according to claim 21, wherein said restriction is carried out by a ring installed in an outer peripheral portion of said tool member.

24. An incremental forming method according to claim 1, wherein said fixing is carried out according to an electromagnetic force.

25. An incremental forming method according to claim 1, wherein said fixing is carried out according to a vacuum-adsorption.

26. An incremental forming method according to claim 1, wherein said fixing is carried out by clamp said material to said seat according to a restriction tool member.

27. An incremental forming method according to claim 1, wherein said material is a pre-foam material having a flange, and between a side face of said tool member and an inner peripheral face of said female die said flange is positioned, and said material is fixed to said seat.

28. An incremental forming method according to claim 1, wherein said tool member is relatively moved from one end side to another end side along to an inner peripheral face of said female die; and said tool is relatively moved from said one end side to said another end side.

29. An incremental forming method according to claim 1, wherein forming a plate by cutting off a plate portion of an extruded frame member;

arranging said cut-off extruded frame member in a seat, relatively moving a tool member to said die, and relatively moving said tool member in an axial direction of said tool member and said die; and incrementally forming said cut-off plate.

30. An incremental forming method, wherein a material is fixed to a seat arranged on an inner side of a female die;

said material is a cylindrical foam member having a flange at an outer periphery thereof;

in said cylindrical foam member, one end side thereof is closed and another end side thereof is enlarged from said one end side;

in an axial direction of said cylindrical foam member, a face which is substantially orthogonal is formed in said one end side;

said face formed in said one end side is fixed to said seat;

in a condition where, between a side face of a tool member arranged on said inner side of said female die and an inner peripheral face of said female die, said flange of said material is positioned, said tool member is moved to said inner peripheral face of said female die in a radial direction thereof; and said tool member is moved along to said inner periphery face of said female die.

31. An incremental forming method according to claim 30, wherein under a condition where said material is sandwiched between a tip end of said tool member and said seat, said tool member is moved in an inner peripheral side of the female die and along said inner peripheral face.

32. An incremental forming method, wherein arranging a seat in an inner side of a female die, and mounting a material on an upper face of said female die and an upper face of said die;

under a condition where an outer end portion of said material is fixed to said female die, relatively moving a tool member arranged in an upper portion of said material toward a recessed portion provided on said upper face of said seat;

carrying out a sponson processing by relatively moving said tool member along to said recessed portion;

releasing said fixing and fixing said material to said seat, under a condition where between said female die and said tool member and between said seat and a tip end of said tool member arranging said material;

relatively moving said die and said tool member toward a drawing processing direction to said female die; and relatively moving said tool member along to an inner peripheral face of said female die.

33. An incremental forming method according to claim 32, wherein said tool member for said sponson processing and said tool member for said drawing processing are the same tool member.

34. An incremental forming method according to claim 32, wherein a movement in said drawing processing direction after a release of said fixing is carried out by a movement of said female die.

35. An incremental forming method, wherein arranging a seat in an inner side of a female die, and mounting a material on an upper face of said female die and an upper face of said seat;

under a condition where an outer end portion of said material is fixed to said female die, relatively moving a tool member arranged in an upper portion of said material toward a peripheral portion of a recessed portion provided on said upper face of said seat, and moving said female die in a movement direction of said tool member;

carrying out a sponson processing by relatively moving said tool member along to said peripheral portion of said recessed portion;

releasing said fixing and fixing said material to said seat, under a condition where between said female die and said tool member and between said seat and said tool member, arranging said material;

relatively moving said seat and said tool member toward a drawing processing direction in said female die; and relatively moving said tool member along to an inner peripheral face of said female die.

36. An incremental forming method according to claim 35, wherein said tool member for said sponson processing and said tool member for said drawing processing are the same tool member.

37. An incremental forming method according to claim 35, wherein a movement in said drawing processing direction after a release of said fixing is carried out by a movement of said female die.

38. An incremental forming method, wherein mounting a material on an upper face of a seat having plural recessed portions;

under a condition where said material is fixed to said seat, relatively moving a tool member provided on an upper portion of said material toward said recessed portion;

carrying out a sponson processing by relatively moving said tool member along to said recessed portion;

moving said tool member in another recessed portion, and carrying out a sponson processing by relatively moving said tool member along to said recessed portion; and to respective portions in which said sponson processing has been carried out, carrying out again said sponson processing by a movement of said tool member.

39. An incremental forming method, wherein arranging a second seat arranged at an inner side of a female die, having plural raised portions on an upper face of said seat;

mounting a material on an upper face of said female die and an upper face of said seat;

under a condition where an outer end portion of said material is fixed to said upper face of said first die, relatively moving a tool member provided on said material toward a peripheral portion of said raised portion, and moving said female die in a movement direction of said tool member;

carrying out a sponson processing by relatively moving said tool member along to said raised portion;

carrying out a sponson processing by relatively moving said tool member along to said raised portion; and to respective portions in which said sponson processing has been carried out, carrying out again said sponson processing by a movement of said female die and a movement of said tool member.

40. An incremental forming apparatus comprises, wherein a base for mounting a female die and a seat arranged in an inner side of said female die and for mounting a material;

a shaft installed on an upper portion of said base and capable to install a tool member directing in a lower portion;

a first movement device for relatively moving said shaft in a vertical direction;

a second movement device for moving one of said seat and said female die in a vertical direction; and a third movement device for relatively moving said shaft in a horizontal direction along to an inner peripheral face of said female die.

41. An incremental forming apparatus according to claim 40, wherein said third movement device comprises a fourth movement device for moving said shaft in a horizontal direction, and a fifth movement device for moving said female die and said seat in a rectangular direction horizontal direction to a movement direction of said fourth movement device.

42. An incremental forming apparatus according to claim 41, wherein said seat is mounted in a lower end of said female die.

43. An incremental forming apparatus according to claim 40, wherein said second movement device is formed to move said seat in said vertical direction to said female die.

44. An incremental forming apparatus according to claim 40, wherein said second movement device is formed to move said female die in said vertical direction to said seat.

45. An incremental forming apparatus comprises, wherein a base capable to mount a female die;

a shaft installed on an upper portion of said base and capable to install a tool member directing in a lower portion;

a first movement device for relatively moving said a shaft in a vertical direction;

a second movement device for moving one of a seat and said female die in a vertical direction; and a third movement device for relatively moving said shaft for in a horizontal direction along to an inner peripheral face of said female die.

46. An incremental forming apparatus comprises, wherein a base for mounting a female die and a seat arranged in an inner side of said female die and having a recessed portion in an upper face;

a shaft installed on an upper portion of said base and capable to install a tool member directing in a lower portion;

a first movement device for relatively moving said shaft in a vertical direction;

a second movement device for moving one of said seat and said female die in a vertical direction; and a third movement device for relatively moving said shaft in a horizontal direction along to said recessed portion of said seat and along to an inner peripheral face of said female die.

47. An incremental forming apparatus comprises, wherein a base for mounting a female die and a seat arranged in an inner side of said female die and having a raised portion in an upper face thereof;

a shaft installed on an upper portion of said base and capable to install a tool member directing in a lower portion;

a first movement device for relatively moving said shaft in a vertical direction;

a second movement device for moving said female die in a vertical direction; and a third movement device for relatively moving said shaft in a horizontal direction along to said raised portion of said seat and along to an inner peripheral face of said female die.

* * * * *